US005263529A

United States Patent [19]

Landis

[11] Patent Number: 5,263,529

[45] Date of Patent: Nov. 23, 1993

[54] DECORATIVE DECAL SYSTEM FOR LOUVERED DEVICES

[76] Inventor: Erma E. Landis, 2522 Midvale Rd. NW., Canton, Ohio 44708

[21] Appl. No.: 844,199

[22] Filed: Mar. 2, 1992

[51] Int. Cl.[5] ..... E06B 9/36

[52] U.S. Cl. ..... 160/236; 428/43; 428/79

[58] Field of Search ..... 160/236, 168.1, 178.1, 160/166.1; 49/92 SS; 428/79, 43, 101, 122; 425/DIG. 61

[56] References Cited

U.S. PATENT DOCUMENTS

| | | | |
|---|---|---|---|
| 2,074,482 | 3/1937 | Martens | 160/236 |
| 2,133,914 | 10/1938 | Burke | 428/79 X |
| 3,472,305 | 10/1969 | Lefes | 160/236 |
| 4,353,759 | 10/1982 | Stallings | 428/79 X |
| 4,358,488 | 11/1982 | Dunklin et al. | 428/79 X |
| 4,400,419 | 8/1983 | Laczynski | 428/79 X |
| 4,842,036 | 6/1989 | Goodman | 160/236 X |
| 4,884,615 | 12/1989 | Hsu | 160/236 |
| 4,895,747 | 1/1990 | Birkholz et al. | 428/43 X |
| 4,899,491 | 2/1990 | Okumoto | 160/236 |
| 4,900,604 | 2/1990 | Martinez et al. | 428/79 |
| 4,911,220 | 3/1990 | Hiller | 160/236 |
| 4,930,562 | 6/1990 | Goodman | 160/236 |
| 5,029,413 | 7/1991 | Jovanvic | 160/236 |

*Primary Examiner*—David M. Purol

*Attorney, Agent, or Firm*—Paul E. Milliken; Lee A. Germain

[57] ABSTRACT

A decorative decal system for louvered devices such as venetian blinds dr mini-blinds which uses a series of easily removable adhesive backed decal strips for application to louvered blinds or windows. Each decal strip contains a segment of a decorative design or other indicia and when all segments are applied to series of louvers in a blind the group of decal strips forms a unitary pattern on the blind.

15 Claims, 5 Drawing Sheets

DECORATIVE DECAL SYSTEM FOR LOUVERED DEVICES

FIELD OF THE INVENTION

This invention relates generally to a decorative decal system for louvered devices such as venetian blinds or mini-blinds and more specifically relates to a series of adhesive backed decal strips for application to louvered blinds or windows.

BACKGROUND OF THE INVENTION

In the past various types of decorative and utilitarian attachments have been applied to louvered blinds or windows. An example of an early decorative device for venetian blinds is shown in U.S. Pat. No. 2,074,482 issued to E.J. Martens which shows hollow blind slats with decorative fillers inserted therein.

U.S. Pat. No. 3,472,305 issued to M.S. Lefes shows adhesive back insulation strips for attachment to venetian blind slats, however, these strips do not have a decorative design. U.S. Pat. No. 5,029,413 issued to B. Jovanovic shows a vertical window blind with transparent vanes covered with multicolored shapes to resemble stained glass. This is not a decal but a particular design of manufactured window blind.

Other examples of decorative or utilitarian attachments to louvered blinds are shown in U.S. Pat. Nos. 4,899,491, 4,911,220 and 4,930,562. None of these patents, however show the use of a fragmented decorative pattern or indicias which when assembled together on a series of louvers will form a unitary pattern.

OBJECTS OF THE INVENTION

It is a primary object of this invention to provide a simple inexpensive decal system for easily applying decorative patterns or indicia to louvered structures such a venetian blinds or mini-blinds.

Another object of this invention is to provide a decal system with individual decal strips which can be easily aligned in the correct position on individual louvers of a window blind to provide a unitary decorative pattern on the blind.

Another object of this invention is to provide a decal system which requires no cutting or pasting but is in ready to apply form.

These and other objects of the invention will become more fully apparent in the following specification and the attached drawings.

SUMMARY OF THE INVENTION

This invention is a decorative decal system for louvered devices having a plurality of elongated louvers supported in substantially parallel relationship to each other and each louver being rotatable about a respective longitudinal axis of such louver for opening and closing the louvered device, a marginal edge of each of said louvers overlapping a marginal edge of the next adjacent louver, thereby providing a hidden portion on the next adjacent louver, when the louvers are in a closed position and the remainder of each next adjacent louver being a visible portion, the system comprising a set of elongated strips of flexible sheet material having an adhesive layer on the bottom side of each strip, and a decorative design segment imprinted on the top side of each strip, each strip being of sufficient width to at least cover the visible portion of a louver to which it is applied when the louvered device is closed, the design segments of the strips forming a composite pattern when attached to louvers of a louvered device in the proper sequence and alignment and a removable bottom cover sheet protecting the adhesive layer of each strip until it is removed to permit the strip to be attached to a louver.

DESCRIPTION OF THE PREFERRED EMBODIMENTS

Figure 1:
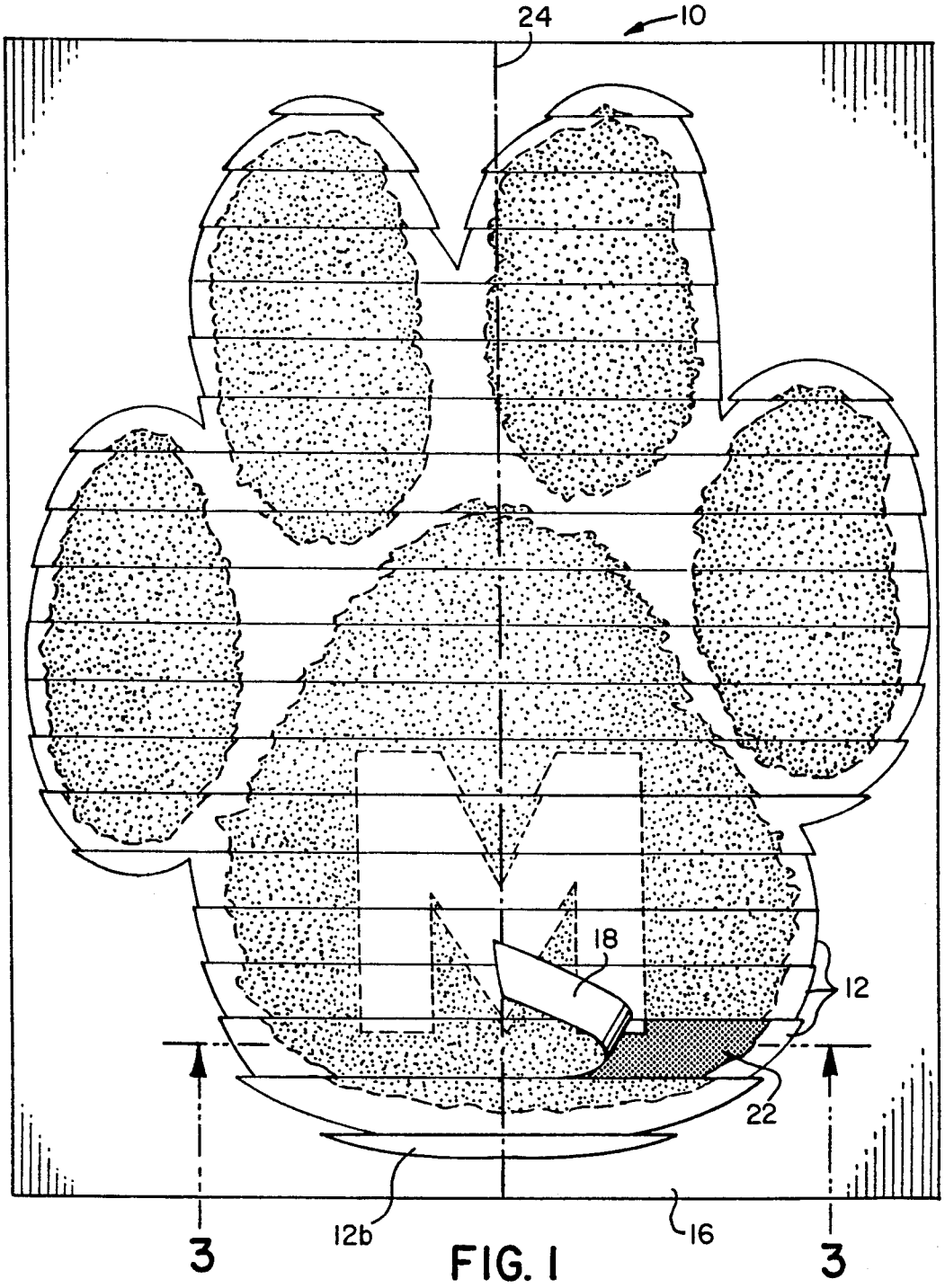
FIG. 1 is a top plan view of an embodiment of the invention including a top cover sheet.
Figure 3:
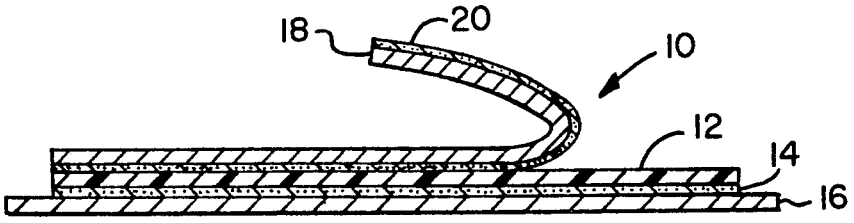
FIG. 3 is a cross-sectional view taken on line 3—3 of FIG. 1.

Referring now to the drawings and in particular to FIGS. 1 and 3 the overall decal system or assembly in indicated by the numeral 10. A plurality of elongated flexible decal strips 12 are attached by a bottom adhesive layer 14 to a bottom cover or support sheet 16. The decal strips 12 are preferably made of a flexible plastic sheet material such as vinyl film or other material with a suitable adhesive on the bottom side which permits the decal to be applied to a window blind louver or other surface but later removed without leaving an adhesive residue. One example of a suitable material for the decal strips 12 is SCPM-3 Application tape manufactured by 3M Company. It is a 4 mil vinyl material with easy remove adhesive on one side thereof. Each decal strip 12 is covered by a top cover sheet 18 or pre-masking tape of paper or other suitable material having an adhesive layer 20 which permits easy removal from the top surface of the decal strip 12 without adhesive residue. The top cover sheet 18 is preferably translucent to permit a decorative design segment 22 to show through the cover sheet 18 to aid in properly positioning it each strip 12 in a desired location on a louver so that all the assembled decal strips 12 when mounted on a series of louvers will form a decorative pattern in the desired location on a blind or other louvered structure.

Figure 2:
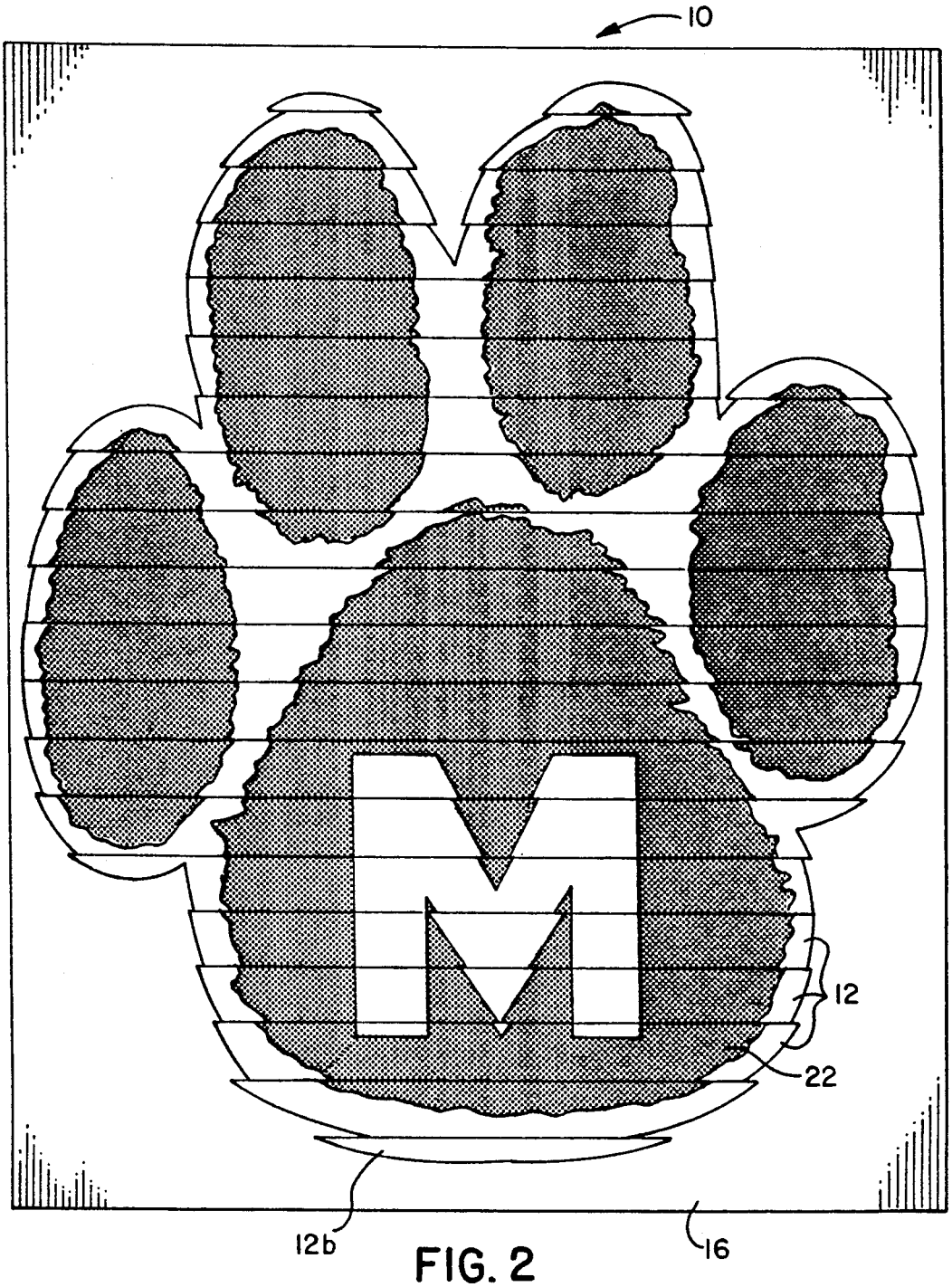
FIG. 2 is a top plan view with the top cover sheet removed from all the strips of the decal to show the appearance of the decal.

In FIG. 1 it can be seen that one of the cover sheets 18 is pulled back to reveal a portion of the decorative design segment 22. FIG. 2 shows the appearance of the decal assembly 10 mounted on the bottom or support sheet 16 with all the strips of translucent top cover sheet 18 removed.

In applying the decal, however, the top cover sheet 18 is normally left on the decal strips 12 until after they are applied to the louvers, since the cover sheet contains a center guide line 24 as shown in FIG. 1 for aligning the strips 12 on the louvers to which they are attached.

Figure 4:
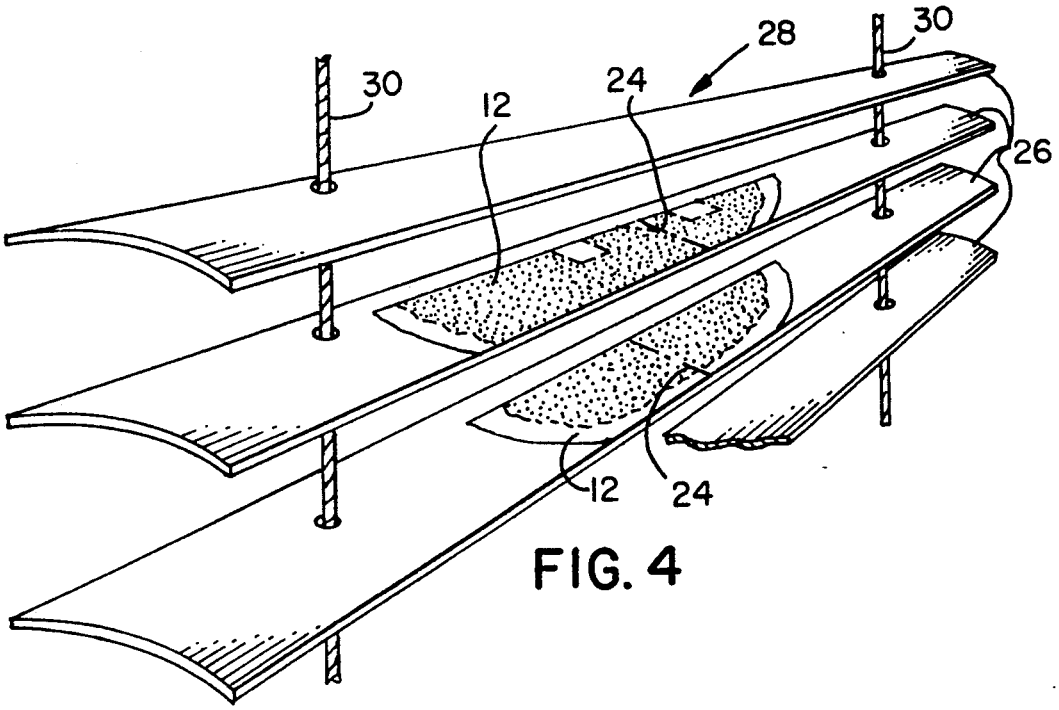
FIG. 4 is a fragmentary perspective view of a typical venetian blind showing how the decal strips are applied to the top of the louvers.

As shown in FIG. 4 each strip 12 is applied in a certain sequence to louvers or slats 26 of a blind 28 having vertical cords 30 which hold the louvers 26 in parallel relationship to each other. While for simplicity, only center cords 30 are shown, in a typical blind there are outer edge cords or bands which are used to change the angle or orientation of the louvers for opening and closing the blind.

Figure 5:
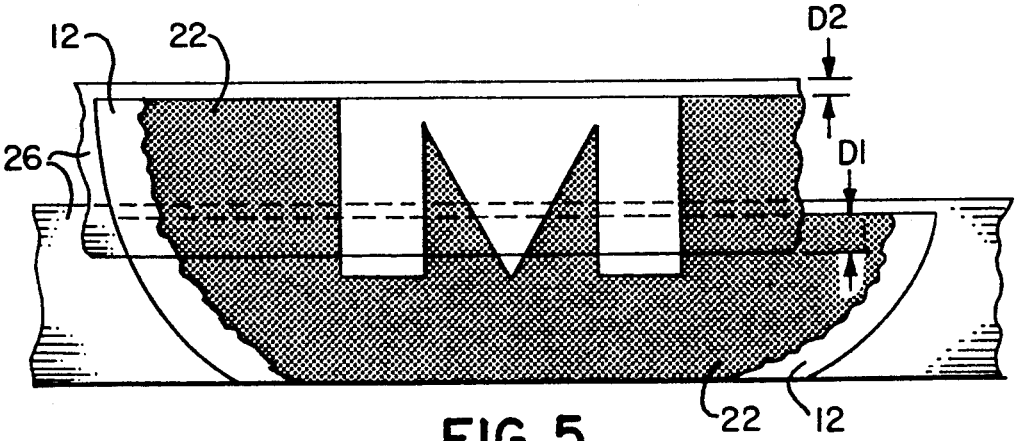
FIG. 5 is a fragmentary front elevational view of a louvered blind showing how the louvers overlap each other and showing the overlap of the decal pattern from one louver to another.

FIG. 5 shows two typical louvers 26 with a decal strip 12 attached to each louver. In many typical blinds having louvers of a certain width and curvature, a decal strip 12 may cover the entire width of each louver, however, the strips 12 need not cover the entire width of a louver but should be wide enough to extend a certain distance D1 beneath the overlap of the next adjacent louver. This assures that when the louvers 26 are partially open or slightly out of alignment, that there will be continuity of the decorative design or pattern. The decal strip 12 can be of a width which may, when used on some widths of louvers, terminate a short distance D2 from the top edge of the louver when the blind is closed.

Figure 6:
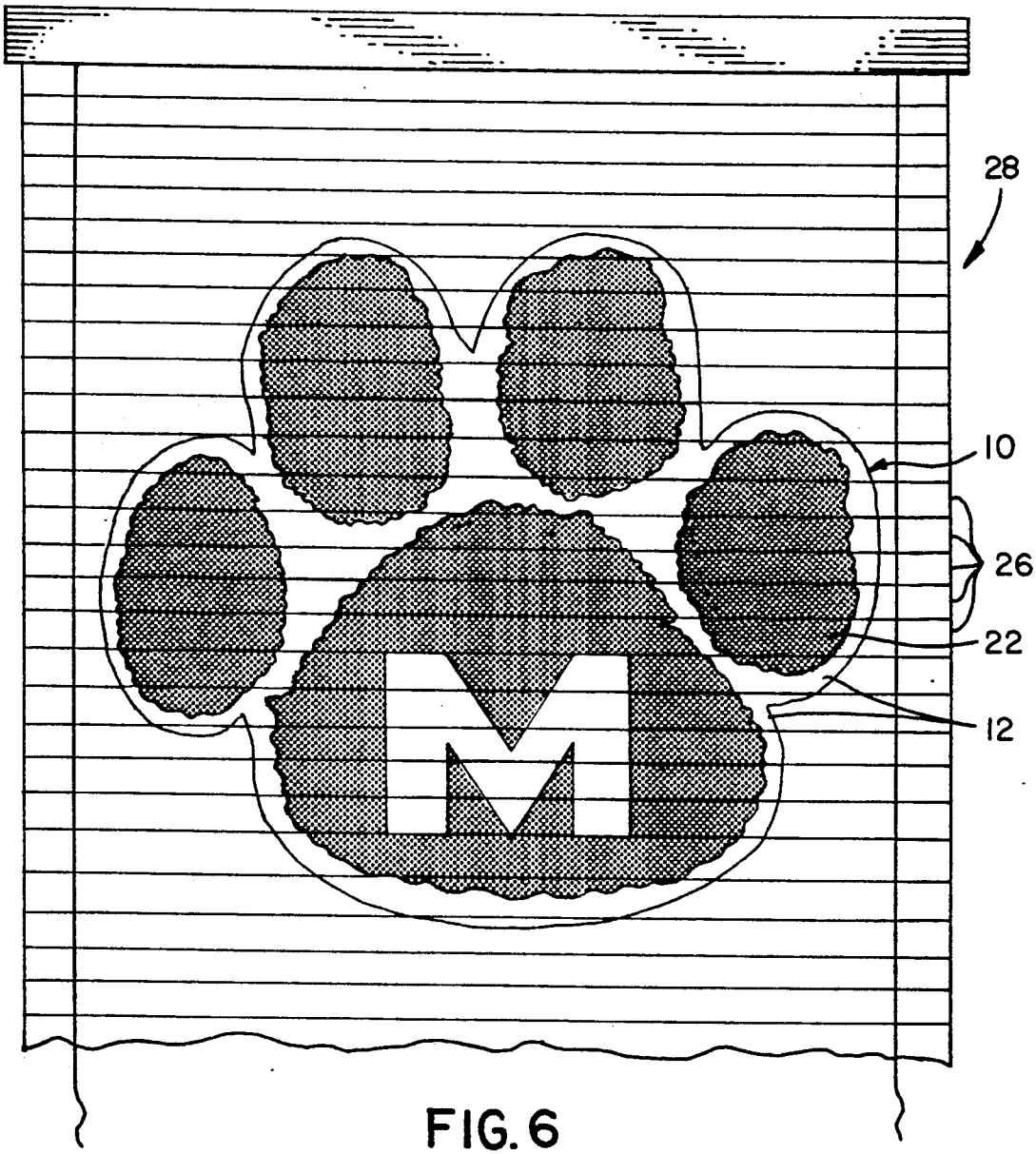
FIG. 6 is a front elevational view of a louvered window blind showing the blind closed and the unitary pattern visible from the front of the blind.

In placing the strips 12 on the louvers 26, the center line 24 on the top cover 18 should be aligned with a mark made on the center of the first louver to receive a decal strip 12 and the bottom edge of the strip should be aligned with the bottom edge of the louver unless the strip 12 is not a full width strip. When a bottom strip such as strip **12*b* (shown in FIGS. 1 and 2) is less than full width, it should be attached to the top portion of the louver 26. Thereafter, each successive decal strip 12 can be aligned with the previous strip 12 by aligning the center line 24 with the center line 24 on the previous strip. After the strips 12 are all in the proper position on the louvers 26 of a blind 28 to create a unitary pattern as shown in FIG. 6, the top cover sheets 18 are removed from the decal strips 12** leaving the pattern fully visible.

Figure 7:
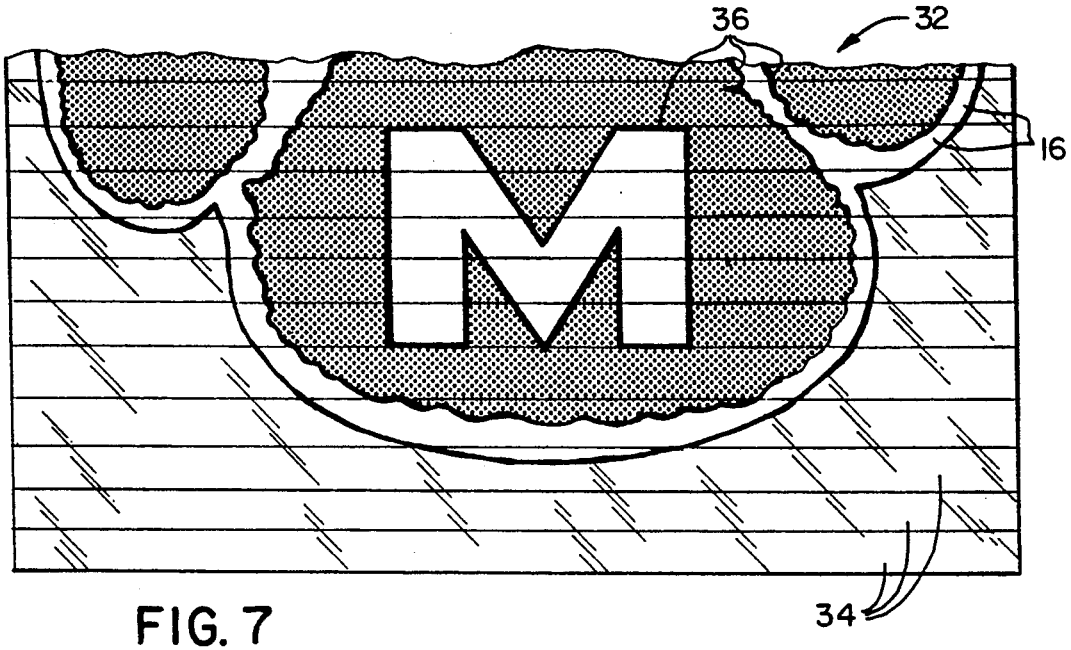
FIG. 7 is a fragmentary front elevational view of another embodiment of the invention showing the decal of the invention mounted on a transparent louvered window to simulate a stained glass window.
Figure 8:
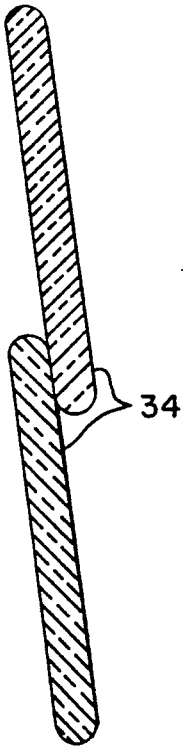
FIG. 8 is a cross sectional view through two typical louvers of the embodiment shown in FIG. 7.

FIG. 7 shows another embodiment of the invention in which, instead of applying the decal to a louvered blind, the decal strips 16 are applied to a louvered window 32 having a plurality of louvers or slats 34 which may be either transparent or translucent glass or plastic material. In FIG. 8 the louvers 34 are shown as being made from glass. To provide the illusion of a stained glass window, the decal design segment 22 may be made transparent or translucent in various colors and the different color sections may be separated by thick borders 36 which simulate leaded borders of a typical stained glass window.

It will be recognized that the width of the decal strips 12 can vary depending upon the width of the louvers or slats of the blind or window, however the main criterion for determining the width is that the decorative pattern covers all the exposed width of the louver so that the pattern is uninterrupted and forms a unitary design on the blind or window. In a typical mini-blind each louver would be 1" (2.54 cm) wide and when the blinds are closed, there would be 7/32" (0.56 cm) overlap of each louver over the next adjacent louver and there would be 25/32" (1.98 cm) width showing on the front surface of each louver and therefore that same width of decal would show when attached to the louver.

While this decal system is primarily designed for use on louvers which can be opened or closed, it can also be applied to a fixed louver assembly.

These and various other modifications can be made herein without departing from the scope of the invention.

What is claimed is:

1. A decorative decal system for louvered devices having a plurality of elongated louvers supported in substantially parallel relationship to each other and each louver begin rotatable about a respective longitudinal axis of such louver for opening and closing the louvered device, a marginal edge of each of said louvers overlapping a marginal edge of the next adjacent louver, thereby providing a hidden portion on the next adjacent louver, when the louvers are in a closed position and the remainder of each next adjacent louver being a visible portion, the system comprising:

(A) a set of elongated strips of flexible sheet material having;

(1) an adhesive layer on the bottom side of each strip, and (2) a decorative design segment imprinted on the top side of each strip, (B) each strip being of sufficient width to at least cover the visible portion of a louver to which ti is applied when the louvered device is closed;

(C) the design segments of the strips forming a composite pattern when attached to louvers of a louvered device in the proper sequence and alignment;

(D) means for aligning each strip in the proper location on each louver when the strips are shorter that the louvers to which they are attached, so that eh design segments of all the strips, when attached to the louvers will provide the appearance of a continuous unitary pattern on the louvered device, said means comprising a top cover sheet applied to the top of each strip, said top cover sheet having at least one locator mark imprinted thereon in a position for alignment with a locator mark on each of the other top sheets; and (E) a removable bottom cover sheet protecting the adhesive layer of each strip until it is removed to permit the strip to be attached to a louver.

2. A decorative decal system as claimed in claim 1 wherein the locator mark is a center line running transversely across the top cover sheet of each strip and located to pass through the center of the pattern when the strips are assembled in an installed position on the louvers of the louvered device.

3. A decorative decal system as claimed in claim 1 wherein the louvered device is a venetian blind.

4. A decorative decal system as claimed in claim 1 wherein the louvered device is a mini-blind.

5. A decorative decal system as claimed in claim 1 wherein the louvered device is a louvered window and the louvers are of a material which will permit the passage of light therethrough.

6. A decorative decal system as claimed in claim 1 wherein each strip is wider than the visible portion of each louver, when the louvered device is closed, to extend the decorative design segment of each strip to cover both the visible portion of the louver and at least part of the hidden portion of the louver, thereby assuring a continuous pattern on the louvered device in case of minor tolerance variations in the overlap of the adjacent louvers.

7. A decorative decal system as claimed in claim 1 wherein the strips of flexible sheet material are made from vinyl film coated on one side with pressure sensitive adhesive having a removable cover thereon.

8. A decorative decal system as claimed in claim 1 wherein the entire set of elongated strips are mounted on a single removeable bottom cover sheet in the proper sequence and spatial relationship in which they are to be applied to the series of louvers on the louvered device.

9. A decorative decal assembly for application to louvered window blinds of the type having a plurality of parallel louvers each of which may be rotated about its own longitudinal axis to move the blind between an open and closed position, the assembly comprising:

(A) a set of elongated strips of flexible sheet material having:
  (1) an adhesive layer on the bottom side of each strip, and
  (2) a decorative design imprinted on the top side of each strip,
(B) each strip being of sufficient width to cover the width of any visible portion of a louver on which it is mounted when the blind is in the closed position;
(C) the design on each of the strips being configured to coordinate with the designs on each of the other strips in the set to form a coordinated and unified effect when attached in the proper sequence to the louvers of a blind and when the blind is closed;
(D) means for aligning each strip in the proper location on each louver when the strips are shorter that the louvers to which they are attached, so that the design segments of all the strips, when attached to the louvers will provide the appearance of a continuous unitary pattern on the louvered device, said means comprising a top cover sheet applied to the top of each strip, said top cover sheet having at least one locator mark imprinted thereon in a position for alignment with a locator mark on each of the other top sheets; and
(E) each of said strips being mounted on a bottom cover sheet during storage and transit which protects the adhesive layer on the bottom side of the strip and prevents it from adhering to objects before it is applied to a louver.

10. A decorative decal assembly as claimed in claim 9 wherein the locator mark is a center line running transversely across the top cover sheet of each strip and located to pass through the center of the pattern when the strips are assembled in an installed position on the louvers of the blind.

11. A decorative decal assembly as claimed in claim 9 wherein the marginal edge of each louver overlaps a marginal edge of the next adjacent louver and thereby causes each louver to have a visible portion and a hidden portion and wherein each strip is wider than the visible portion of each louver, when the blind is closed, to extend the decorative design of each strip to cover both the visible portion of the louver and at least part of a hidden portion of the louver, thereby assuring a continuous pattern on the louvered device in case of minor tolerance variations in the overlap of the adjacent louvers.

12. A decorative decal assembly as claimed in claim 9 wherein the strips of flexible sheet material are made from vinyl film coated on one side with pressure sensitive adhesive having a removable cover thereon.

13. A decorative decal assembly as claimed in claim 9 wherein the entire set of elongated strips are mounted on a single removeable bottom cover sheet in the proper sequence and spatial relationship in which they are to be applied to the series of louvers on the blind.

14. A decorative decal assembly as claimed in claim 9 wherein the adhesive layer has suffient adhesion properties to retain the strips in position upon the louvers but will permit the strips to easily removed from the louvers without leaving any residue of adhesive on the louvers.

15. A decorative decal assembly for application to louvered window blinds of the type having a plurality of parallel louvers each of which may be rotated about its own longitudinal axis to move the blind between an open and closed position, the assembly comprising:

(A) a set of elongated strips of flexible sheet material having;
  (1) an adhesive layer on the bottom side of each strip, and
  (2) a decorative design segment visible on at least the top side of each strip,
(B) each strip being of sufficient width to cover the width of any visible portion of a louver on which it is mounted when the blind is in the closed position;
(C) the design segments on each of the strips being configured to coordinate with the design segments on each of the other strips in the set to form a coordinated and unified effect when attached in the proper sequence t the louvers of a blind and when the blind is closed; and
(D) means associated with the strips for aligning the strips with respect to each other on the louvers so that the design segments on all of the strips will provide the appearance of a continuous unitary pattern on the blind, said means comprising a top cover sheet applied to the top of each strip, said top cover sheet having at least one locator mark imprinted thereon in a position for alignment with a locator mark on each of the other top sheets.

* * * * *